US006254693B1

(12) United States Patent
Dawson et al.

(10) Patent No.: US 6,254,693 B1
(45) Date of Patent: Jul. 3, 2001

(54) GOLF EQUIPMENT STORAGE DEVICE AND METHOD OF USING THE SAME

(76) Inventors: Brian C. Dawson, 4105 Cobridge Way, San Diego, CA (US) 92117; Brendan K. Ozanne, 12908 Caminito Beso, San Diego, CA (US) 92130

( * ) Notice: Subject to any disclaimer, the term of this patent is extended or adjusted under 35 U.S.C. 154(b) by 0 days.

(21) Appl. No.: 09/635,505

(22) Filed: Aug. 9, 2000

(51) Int. Cl.[7] ..... B08B 1/00

(52) U.S. Cl. ..... 134/6; 134/42; 15/161; 15/215; 15/216; 15/217; 15/258; 15/259; 206/38; 206/216; 206/223; 206/315.1; 206/570

(58) Field of Search ..... 134/6, 42; 15/161, 15/215, 216, 217, 258, 259; 206/223, 216, 570, 38, 315.1

(56) References Cited

U.S. PATENT DOCUMENTS

| | | | | |
|---|---|---|---|---|
| 1,759,398 | | 5/1930 | Hart . | |
| 1,810,491 | | 6/1931 | MoClure . | |
| 3,128,021 | | 4/1964 | Habbena | 224/29 |
| 3,611,450 | | 10/1971 | Bost | 4/166 |
| 3,747,150 | * | 7/1973 | Kozub | 15/105 |
| 4,066,156 | | 1/1978 | Basile | 190/18 A |
| 4,082,209 | | 4/1978 | Sanders | 224/29 |
| 4,303,367 | | 12/1981 | Bott | 414/522 |
| 4,358,867 | * | 11/1982 | Berle | 15/36 |
| 4,571,767 | * | 2/1986 | Dengler | 15/161 |
| 4,687,096 | | 8/1987 | Mansur | 206/315.9 |
| 4,942,990 | | 7/1990 | White | 224/42.42 |
| 5,075,917 | | 12/1991 | Wheat | 15/161 |
| 5,186,374 | | 2/1993 | Buxton | 224/191 |
| 5,345,641 | * | 9/1994 | Webster | 15/105 |
| 5,437,075 | * | 8/1995 | Peake | 15/161 |
| 5,479,674 | | 1/1996 | Gilcrest | 15/161 |
| 5,480,078 | | 1/1996 | Verrette et al. | 224/274 |
| 5,494,202 | | 2/1996 | Wyatt | 224/253 |
| 5,878,881 | | 3/1999 | Hunt | 206/361 |
| 5,970,561 | | 10/1999 | Archibeque | 15/161 |
| 6,032,316 | * | 3/2000 | Peake et al. | 15/161 |

* cited by examiner

*Primary Examiner*—Sharidan Carrillo
(74) *Attorney, Agent, or Firm*—Lyon & Lyon LLP

(57) ABSTRACT

The invention relates to a golf equipment storage device for use in an automobile for convenient transport of various golfing equipment. The golf equipment storage device includes a compartment for holding golf shoes, and a removable liner normally disposed therein. The removable liner has an abrasive surface that can be used to clean grass and debris off of golf cleats and the bottoms of golf shoes. The removable liner may also have a non-abrasive surface that the user may stand on when changing shoes. In use, the removable liner is removed and the user wipes the bottoms of the golf shoes and the golf cleats on the abrasive surface for cleaning. The removable liner is then restored to the compartment, and the golf shoes may then be placed on top of the liner for transport and storage.

8 Claims, 2 Drawing Sheets

GOLF EQUIPMENT STORAGE DEVICE AND METHOD OF USING THE SAME

BACKGROUND OF THE INVENTION

1. Field of the Invention

The present invention relates, in general, to a device and method used to store golf equipment, and, in particular, to a golf equipment storage device for an automobile.

2. Discussion of Related Art

Most golf courses require golfers to wear golf shoes including cleats to help prevent damage to the grass in the tee boxes, fairways, and especially the greens. After a round of golf, a golfer typically returns to his or her automobile and changes from golf shoes into street shoes. The golf shoes are typically thrown into the trunk or rear of the automobile, and left in the automobile until the next time the golfer plays golf or until the golfer returns home and removes the shoes from the trunk or rear of the automobile. A problem with this approach is that during a round of golf the cleats tend to accumulate grass and other debris. This grass and other debris dislodges from the cleats during driving, and creates a mess in the automobile.

A need therefore exists for a golf equipment storage device and method that eliminates this problem with grass and other debris dislodging from the cleats of golf shoes, and making a mess in an automobile.

SUMMARY OF THE INVENTION

An aspect of the present invention involves a golf equipment storage device that comprises a golf shoe compartment adapted to receive a pair of golf shoes including golf cleats, and a removable liner normally stored within the golf shoe compartment. The removable liner includes an abrasive surface adapted to remove grass and other debris from the golf cleats. The removable liner may include an abrasive side and a non-abrasive side. In storage, the abrasive side is normally faced down against the floor of the golf shoe compartment.

Implementations of the aspect of the invention described above may include one or more of the following. The golf equipment storage device also has at least one additional storage compartment for miscellaneous golf equipment. The go additional storage compartment may comprise a golf ball compartment adapted to store golf balls. The golf equipment storage device is adapted to fit in the rear of an automobile.

Another aspect of the present invention relates to a method of using a golf equipment storage device. The method includes removing a removable liner from the golf equipment storage device and using the abrasive surface to wipe grass and other debris off the cleats of the golfer's shoes.

Implementations of the aspect of the invention described immediately above may include one or more of the following. The removable liner has a non-abrasive surface that the golfer may stand on while changing into or out of golf shoes. After changing out of the golf shoes, the golfer may store the liner in the golf shoe compartment abrasive side down, with the golf shoes on top of the non-abrasive side.

Other features and advantages of the invention will be evident from reading the following detailed description, which is intended to illustrate, but not limit, the invention.

BRIEF DESCRIPTION OF DRAWINGS

The drawings illustrate the design and utility of preferred embodiments of the present invention, in which.

DETAILED DESCRIPTION OF PREFERRED EMBODIMENTS

Figure 1:
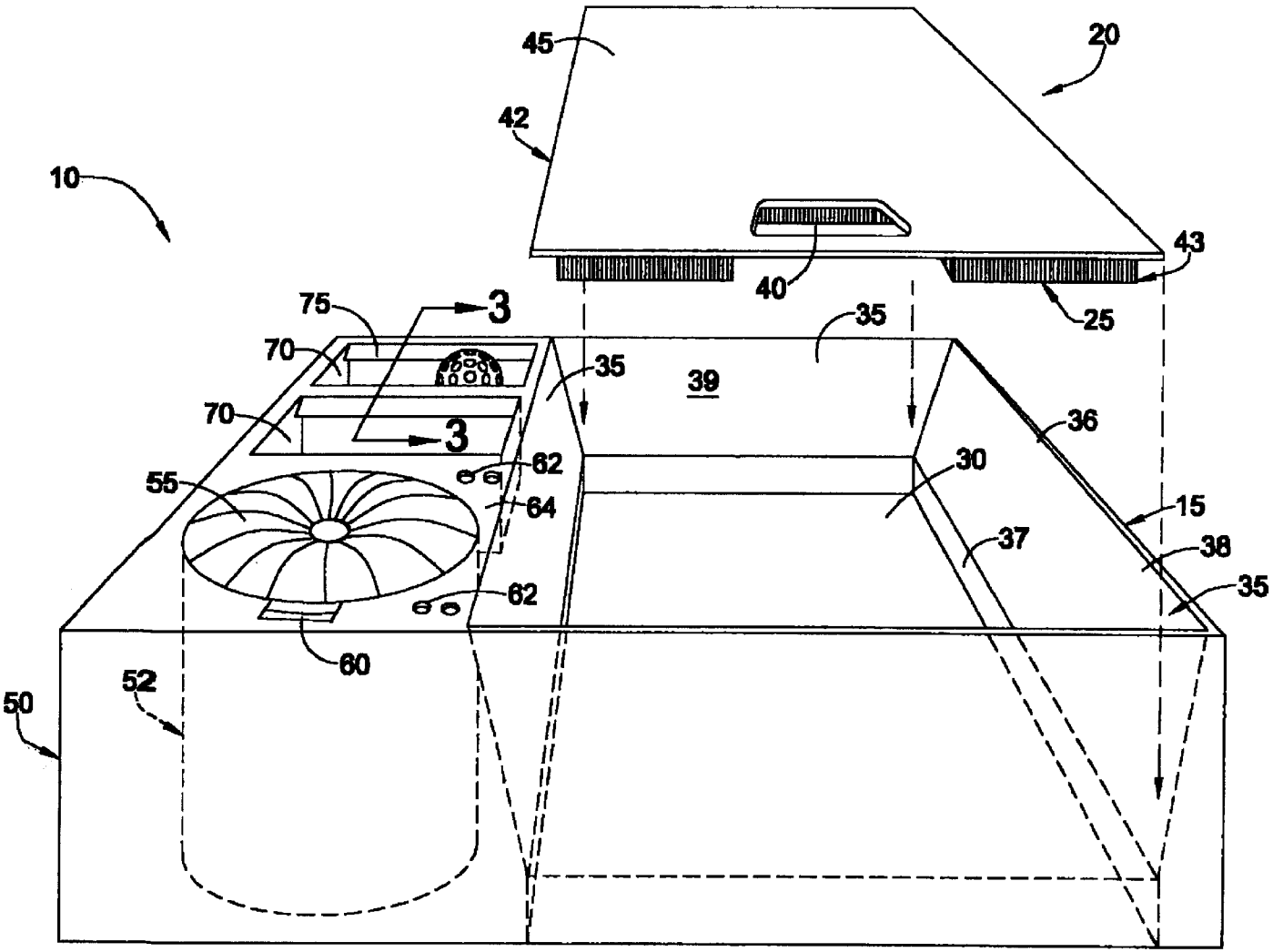
FIG. 1 is a perspective view of an embodiment of a golf equipment storage device, shown with a removable liner in a removed position.
Figure 2:
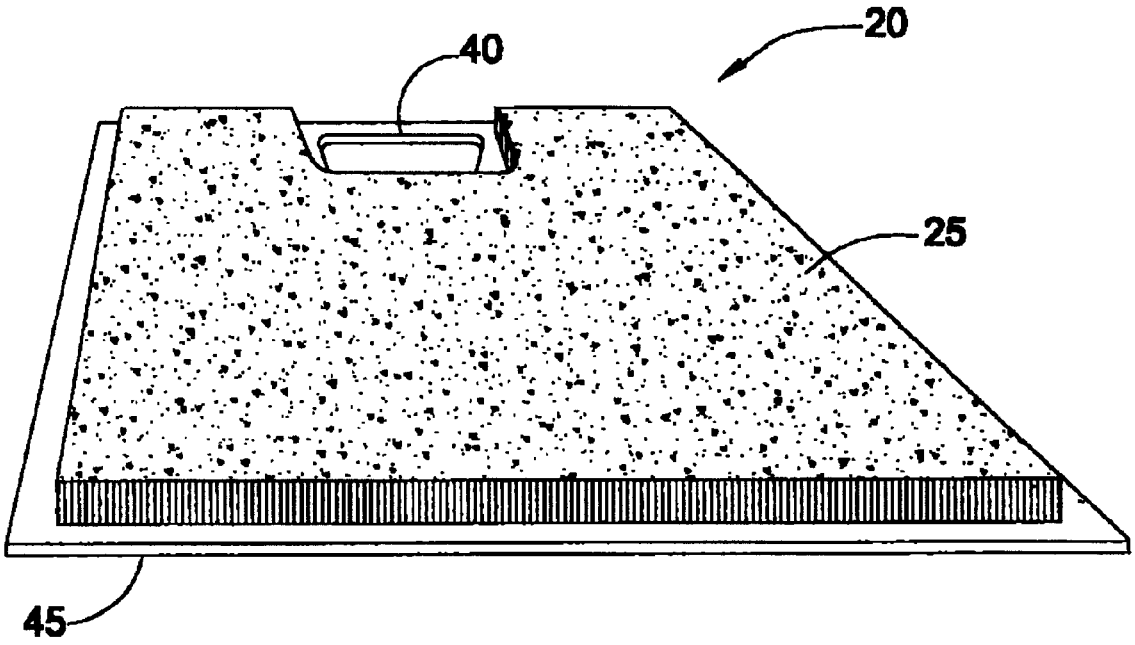
FIG. 2 is a perspective view of the removable liner illustrated in FIG. 1, shown with an abrasive side faced up.
Figure 3:
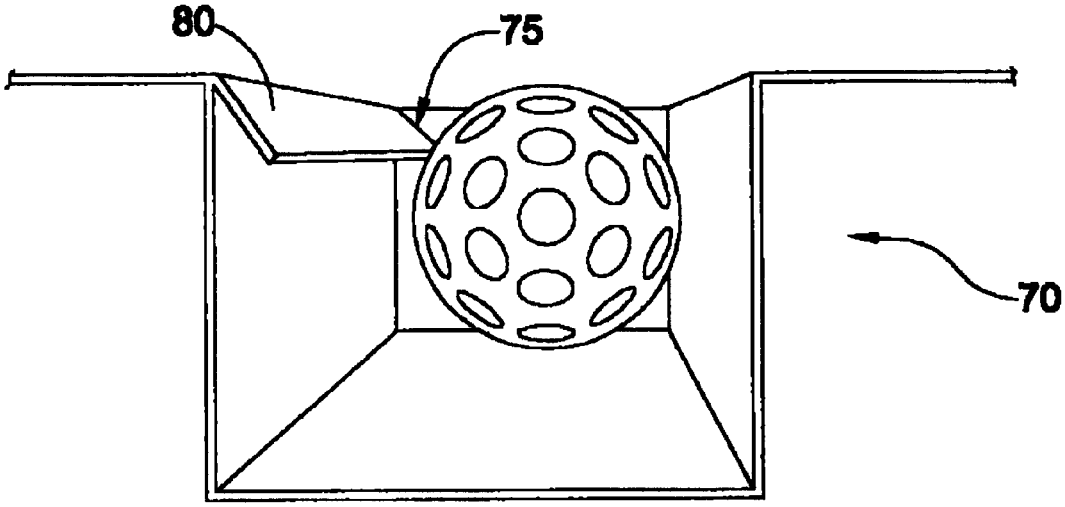
FIG. 3 is a perspective, side-elevational view of the golf ball compartment shown in FIG. 1, taken along line 3—3.

With reference to FIGS. 1–3, a golf equipment storage device 10 constructed in accordance with an embodiment of the invention will now be described. The golf equipment storage device 10 includes a golf shoe compartment 15 adapted to receive a pair of golf shoes including golf cleats and a removable liner 20 adapted to be removably disposed within the golf shoe compartment 15. Preferably, the golf equipment storage device 10 is about the size of about two shoeboxes and is designed to fit in a trunk or rear of an automobile.

The golf shoe compartment 15 may have an open top and a generally rectangular box shape defined by walls 35 and a floor 30. The golf shoe compartment 15 is preferably made out of plastic and is injection molded. However, other materials, e.g., metal such as aluminum, and manufacturing techniques, e.g., casting, stamping, extruding, may be used. The walls 35 may include side walls 36 having a vertical lower portion 37 that is generally perpendicular to the floor 30 and an upper portion 38 that has a slight outward angle with respect to the lower portion 37. The angle of the side walls 36 allows the removable liner 20 to be easily removed and replaced. End walls 39 may exist at opposite ends of the compartment 15. It will be readily apparent to those skilled in the art that the golf shoe compartment 15 may include configurations other than that shown. For example, instead of an open top, the top may be closed and the side(s) 36 may be open or the end(s) 39 may be open. Further, the golf shoe compartment 15 may have a shape other than generally rectangular box shape, such as, but not by way of limitation, oval, round, trapezoidal, polygonal, etc.

The removable liner 20 preferably includes a backing 42 and an abrasive material 43. The abrasive material 43 preferably comprises a plurality of abrasive bristles covering substantially one side of the liner 20. The ends of the abrasive bristles form the abrasive surface 25 adapted to remove grass and other debris from the golf cleats of golf shoes.

The backing 42 preferably includes a generally rectangular shape, but as described above with respect to the compartment 35, other shapes may be used. The backing 42 forms, in part, a non-abrasive surface 45 on the other side of the liner 20. The backing 42 may be made out of a plastic material or other material such as, but not by way of limitation, metal, wood, plastics, rubbers and other polymers.

A handle 40 may be disposed at an end of the liner. In other embodiments, the liner 20 may include a handle located at other locations, e.g., side, corner, may include multiple handles, or no handle. The handle 40 is created by placing a rectangular hole in the backing 42, adjacent one end of the liner 20. It will be readily apparent to those skilled in the art that other types of handles such as, but not by way of limitation, knobs or other gripable protrusions may be used.

The removable liner 20 is preferably normally disposed on the floor 30 of the golf shoe compartment 15 with the abrasive surface 25 faced down.

Although the liner 20 is shown with an abrasive surface 25 and a non-abrasive surface 45, in other embodiments, the liner 20 may include an abrasive surface 45 on both sides of the liner 20 or the abrasive surface 25 may be located on less than substantially all of one or both sides.

In other embodiments, the golf equipment storage device 10 may include one or more additional compartments 50 for storing additional golf equipment. FIG. 1 illustrates the one or more additional compartments 50 located adjacent to the golf shoe storage compartment 15. In alternative embodiments, the one or more additional compartments 50 may be located above or at least partially above the golf shoe storage compartment 15, or the golf shoe storage compartment 15 may be located between additional compartments 50.

The one or more additional compartments 50 may include a compartment 52 for storing tees or other items. The compartment 52 may include a snap-on lid 55. A recess 60 allows access for removing the lid 55 with one's fingers.

A plurality of holes 62 in an upper surface 64 of the device 10 may be used to hold a plurality of golf tees.

With reference additionally to FIG. 3, the one or more additional compartments 50 may include one or more golf ball compartments 70. The golf ball compartment 70 may include a retaining mechanism 75 for retaining golf balls in the compartment 70. In the embodiment shown, the retaining mechanism 75 is an angled lip 80. The lip 80 is made of a resilient material and sized to allow a golf ball to pass through an opening in the golf ball compartment 70 when pressure is applied. The resilient nature of the lip 80 causes it to return to its original shape. It will be readily apparent to those skilled in the art that the retaining mechanism 75 may take alternate forms such as, but not by way of limitation, a spring mechanism, a lid, and other resilient protrusions.

In use, the removable liner 20 is preferably stored with the abrasive surface 25 faced down in the golf shoe storage compartment 15. The golfer may store golf shoes on top of the non-abrasive surface 45 of the removable liner 20 in the golf shoe storage compartment 15.

After a round of golf, the golfer may return to his or her automobile, open the trunk or hatch, remove a pair of street shoes (if previously placed in the golf shoe storage compartment 15), and remove the removable liner 20 using the handle 40.

The removable liner 20 may then be placed on the ground, abrasive surface 25 facing up. The golfer may then wipe the golf cleats and the bottoms of the golf shoes on the abrasive surface 25, removing grass and other debris from the cleats. The removable liner 20,may then be reversed so that the abrasive surface 25 is facing down, and the golfer may stand on the non-abrasive surface 45 while changing from golf shoes to street shoes.

In a similar fashion, the user may change from street shoes to golf shoes before playing golf while standing on the non-abrasive surface 45 of the removable liner 20. Not only does reversing the liner 20 so that the non-abrasive surface 45 is facing up provide a more comfortable standing surface for the golfer when changing from golf shoes to street shoes or vice versa, but reversing and standing on the liner 20 may cause grass and other debris collected on the abrasive surface 25 to become dislodged outside of the automobile. However, to remove further grass and other debris from the abrasive surface 25, the non-abrasive side 45 of the liner 20 may be swatted against the bumper of the automobile or other surface. The removable liner 20 is then restored to the floor 30 of the golf shoe compartment 15, preferably abrasive surface 25 faced down, and the user may store the golf shoes in the golf shoe storage compartment 15.

While preferred embodiments and methods have been shown and described, it will be apparent to one of ordinary skill in the art that numerous alterations may be made without departing from the spirit or scope of the invention. Therefore, the invention is not limited except in accordance with the following claims.

We claim:

1. A method of cleaning golf shoes using a golf equipment storage device positioned in an automobile, comprisig the steps of:

providing a golf equipment storage device having a golf shoe compartment;

removing a liner from the golf shoe compartment of the golf equipment storage device positioned in the automobile, the liner including an abrasive surface and a non-abrasive surface;

placing the liner on the ground so that the abrasive surface of said liner is facing upward;

removing grass and other debris from golf cleats of golf shoes by wiping the golf cleats and bottoms of the golf shoes on the abrasive surface of said liner;

reversing the liner so that the non-abrasive surface is facing upward;

standing on said non-abrasive surface while changing from said golf shoes to street shoes; and restoring the liner into the golf shoe compartment of the golf equipment storage device.

2. The method of claim 1, wherein the non-abrasive surface is plastic.

3. The method of claim 1, further including at least one additional storage compartment to store golf equipment.

4. The method of claim 1, further including standing on said non-abrasive surface while changing from said street shoes to said golf shoes before playing golf.

5. The method of claim 1, further including storing the liner in said golf shoe compartment with the abrasive surface facing downward and with said golf shoes on top of said non-abrasive surfce of said liner.

6. The method of claim 3, wherein said at least one additional storage compartment includes a golf ball compartment to store golf balls.

7. The method of claim 3, wherein said at least one additional compartment is located adjacent to the golf shoe compartment.

8. The method of claim 6, wherein the golfball compartment includes a retaining mechanism to retain the golf balls in said golf ball compartment.

* * * * *